US010934983B2

(12) United States Patent
Kwak

(10) Patent No.: US 10,934,983 B2
(45) Date of Patent: Mar. 2, 2021

(54) AIR CLEANER ASSEMBLY OF VEHICLE HAVING SUPPORTING MEMBERS

(71) Applicants: Hyundai Motor Company, Seoul (KR); Kia Motors Corporation, Seoul (KR)

(72) Inventor: Seong-Youn Kwak, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 194 days.

(21) Appl. No.: 16/194,805

(22) Filed: Nov. 19, 2018

(65) Prior Publication Data

US 2019/0186447 A1 Jun. 20, 2019

(30) Foreign Application Priority Data

Dec. 15, 2017 (KR) ..... 10-2017-0172981

(51) Int. Cl.

| | |
|---|---|
| ***F02M 35/024*** | (2006.01) |
| ***F02M 35/14*** | (2006.01) |
| ***F02M 35/12*** | (2006.01) |
| ***F02M 35/02*** | (2006.01) |

(52) U.S. Cl.

CPC .... *F02M 35/1294* (2013.01); *F02M 35/0201* (2013.01); *F02M 35/024* (2013.01); *F02M 35/1216* (2013.01); *F02M 35/1288* (2013.01)

(58) Field of Classification Search

CPC ..... F02M 35/1294; F02M 35/1216; F02M 35/0201; F02M 35/024; F02M 35/1288; F02M 35/0202; F02M 35/02416; F02M 35/14

USPC ..... 55/385.3, 418; 123/198 E; 180/219; 181/276

See application file for complete search history.

(56) References Cited

U.S. PATENT DOCUMENTS 4,713,097 A * 12/1987 Grawi ..... F02M 35/14 123/198 E
5,106,397 A * 4/1992 Jaroszczyk ..... B01D 46/0043 181/276

(Continued)

FOREIGN PATENT DOCUMENTS

JP H10288102 A 10/1998
JP 2008-075459 A 4/2008

(Continued)

*Primary Examiner* — Minh Chau T Pham

(74) *Attorney, Agent, or Firm* — Mintz Levin Cohn Ferris Glovsky and Popeo, P.C.; Peter F. Corless

(57) ABSTRACT

An air cleaner assembly includes an air cleaner body into which air flows from outside, an air cleaner cover which is fastened to the air cleaner body and from which the filtered air is exhausted, and an air filter installed between the air cleaner body and the air cleaner cover to filter foreign material, and which is installed at an intake pipe introducing air into an engine from outside, where a diffuser guiding the exhaust of the filtered air is installed at the air cleaner cover; and the supporting member, which supports an outside surface of the diffuser on the air cleaner body and the air cleaner cover and allows air to pass in a longitudinal direction of the diffuser, is installed at the air cleaner body and the air cleaner cover, respectively, thereby supporting the diffuser and tuning the intake sound by the air flowing therein.

14 Claims, 12 Drawing Sheets

(56) References Cited

U.S. PATENT DOCUMENTS

| | | | | |
|---|---|---|---|---|
| 6,409,784 | B1 * | 6/2002 | Wehr | B01D 46/0002 123/198 E |
| 7,604,677 | B2 * | 10/2009 | Tsuruta | B01D 46/48 55/385.3 |
| 7,699,912 | B2 | 4/2010 | Uemura et al. | |
| 8,287,614 | B2 | 10/2012 | Gillispie et al. | |
| 8,302,722 | B2 * | 11/2012 | Fujiyama | F02M 35/162 180/219 |
| 9,359,982 | B2 * | 6/2016 | Oh | F02M 35/14 |
| 10,316,804 | B2 * | 6/2019 | Hasenfratz | B01D 46/001 |
| 10,427,080 | B2 * | 10/2019 | Stark | F02M 35/0223 |
| 10,619,607 | B2 * | 4/2020 | Bringhurst | F02M 35/0201 |
| 10,662,907 | B2 * | 5/2020 | Dirnberger | F02M 35/021 |
| 2003/0029145 | A1 * | 2/2003 | Sudoh | B01D 46/10 55/418 |
| 2012/0110964 | A1 * | 5/2012 | Alexander | B01D 46/0024 55/385.3 |
| 2016/0097353 | A1 * | 4/2016 | Birtok-Baneasa | F02M 35/10013 55/385.3 |

FOREIGN PATENT DOCUMENTS

| | | | |
|---|---|---|---|
| JP | 2014-218895 | A | 11/2014 |
| KR | 10-2012-0051389 | A | 5/2012 |
| KR | 20-2015-0003396 | U | 9/2015 |
| KR | 10-1611031 | B1 | 4/2016 |
| KR | 10-2016-0113434 | A | 9/2016 |

* cited by examiner

AIR CLEANER ASSEMBLY OF VEHICLE HAVING SUPPORTING MEMBERS

CROSS-REFERENCE TO RELATED APPLICATION

This application claims under 35 U.S.C. § 119(a) the benefit of Korean Patent Application No. 10-2017-0172981, filed on Dec. 15, 2017, the entire contents of which are incorporated herein by reference.

BACKGROUND

(a) Technical Field

The present disclosure relates to an air cleaner of a vehicle configured to filter and substantially prevent foreign material contained in air from flowing into an engine of the vehicle, more particularly, to an air cleaner assembly of the vehicle having a supporting member capable of tuning an intake sound by air flowing in an interior of the engine while supporting a diffuser which is a passage through which the filtered air is discharged.

(b) Description of the Related Art

Air required for combustion in an engine of a vehicle is introduced into the engine through an intake pipe from the outside, and an air cleaner is installed in the middle thereof to filter foreign material.

As shown in FIG. 1 (RELATED ART), an inner space is formed in an intake pipe introducing outside air into an engine by an air cleaner body 111 and an air cleaner cover 112 inserted into the air cleaner body 111, and the inner space is provided with an air cleaner 110 having an air filter 113 to filter foreign material contained in the air introduced into the engine.

Further, as shown in FIG. 2 (RELATED ART), a sound generator 121 for tuning an intake sound is also installed at an intake pipe 120. The sound generator 121 is installed in a tube communicated with the intake pipe 120 and the interior of the vehicle to tune the intake sound. The sound generator 121 is provided with a membrane 121*b*, which is compressed and expanded in a longitudinal direction of the tube, while traversing the tube in a housing 121*a*, and amplifies the sporty sound by applying vibration to the membrane using the engine pulsation pressure to tune the intake sound. There are, however, problems in that the tuning frequency band is narrow and a constraint in accordance with the engine compartment layout becomes large.

On the other hand, FIG. 3 (RELATED ART) shows an electronic sound generator in which a driver 131 generating the tuned intake sound at a cowl panel 130 of a vehicle and a controller 132 controlling the driver 131 are installed, so that the tuned intake sound is generated through the driver 131. There is, however, a problem that the structure is complicated and cost and weight are increased since it is necessary to install a separate driver (i.e., the driver 131).

In addition, the air cleaner typically has been manufactured using molds, so there is a problem in that as the specifications of the air cleaner vary, the number of molds increases accordingly. To increase the radiation sound of the air cleaner, the shape of the rib formed inside the air cleaner should be changed. Also, since the radiated sound to be implemented differs according to the type of vehicle, the mold for the air cleaner should be provided for each vehicle type for this purpose. Additionally, because the radiated sound required in a derivative model (e.g., sports model) is different even in the same type or model of vehicle, a separate mold is required for this purpose. Thus, even if the shape of the air cleaner is slightly changed, a new mold is needed, which increases the production cost.

The foregoing is intended merely to aid in the understanding of the background of the present disclosure, and is not intended to mean that the present disclosure falls within the purview of the related art that is already known to those skilled in the art.

SUMMARY

The present disclosure provides an air cleaner assembly of a vehicle having a supporting member which supports a diffuser from which filtered air is discharged and which is easily attached and detached from the air cleaner assembly.

Another object of the present disclosure is to provide an air cleaner assembly of a vehicle having a supporting member capable of tuning intake sound by controlling air flow therein.

Yet another object of the present disclosure is to provide an air cleaner assembly of a vehicle having a supporting member capable of changing and/or modifying the supporting member fitted to the inside according to a required specification of the air cleaner.

An air cleaner assembly of a vehicle having a supporting member according to the present disclosure may include an air cleaner body into which air flows from outside, an air cleaner cover which is fastened to the air cleaner body and from which the filtered air is exhausted, and an air filter installed between the air cleaner body and the air cleaner cover to filter foreign material, and which is installed at an intake pipe introducing air into an engine from outside, where a diffuser guiding the exhaust of the filtered air is installed at the air cleaner cover, and where the supporting member, which supports an outside surface of the diffuser on the air cleaner body and the air cleaner cover and allows air to pass in a longitudinal direction of the diffuser, is installed at the air cleaner body and the air cleaner cover, respectively.

The supporting member may be formed to extend in a radial direction of the diffuser to be in contact with an inside surface of the air cleaner body or an inside surface of the air cleaner cover.

The supporting member may be a lower support which supports an outer lower end portion of the diffuser and contacts with the inside surface of the air cleaner body.

An air filter may be installed between the lower support and the diffuser.

The lower support may include a rim portion supporting the inside surface of the air cleaner body and a lower surface of the air filter; and lower reinforcing ribs dividing an inner space in an inside of the rim portion and forming through-holes of a constant cross-sectional area in the longitudinal direction of the diffuser.

A part of the rim portion contacting the air cleaner body may form a lower support fixing flange which extends in the longitudinal direction of the diffuser; and a lower support holder may be formed to protrude from the inside surface of the air cleaner body and accommodate the lower support fixing flange, so that the lower support fixing flange is fixedly fitted to the lower support holder.

A lower support fixing protrusion may be formed at the inside surface of the air cleaner body to protrude from the inside surface of the air cleaner body; and a fixing groove accommodating the lower support fixing protrusion may be formed at the rim portion of the lower support, so that the lower support fixing protrusion is fixedly fitted to the fixing groove when the lower support is seated at a predetermined position inside the air cleaner body.

An intake sound may be tuned by changing a size and shape of the through-holes formed inside the lower reinforcing ribs.

The lower support of which the shapes of the lower reinforcing ribs are changed according to a required specification of the air cleaner may be fitted to the air cleaner body.

The supporting member may be an upper support which supports the outside circumference of the diffuser and contacts the inside surface of the air cleaner cover.

The upper support may include an outer rim contacting with the inside surface of the air cleaner cover; an inner rim of which the middle portion covers the outside circumference of the diffuser, the portion not adjacent to the diffuser is in contact with the upper surface of the air filter and both end portions are connected with the outer rim, respectively; and upper reinforcing ribs dividing the inner space formed by the outer rim and the inner rim and forming through-holes of a constant cross-sectional area along the longitudinal direction of the diffuser.

One side of the outer rim may form an upper support fixing flange to extend in longitudinal direction of the diffuser; and an upper support holder accommodating the upper support fixing flange may be formed at the inside surface of the air cleaner cover, so that the upper support fixing flange is fitted to the upper support holder in order that the upper support is mounted on the air cleaner cover.

An upper support fixing hook hanged on the upper end portion of the upper support holder may be formed at the upper end portion of the upper support fixing flange in order to prevent the upper support fixing flange from being separated from the upper support holder.

A penetration hole may be formed at the inner rim; and a diffuser fixing protrusion inserted into the penetration hole may be formed at the outside surface of the diffuser, so that the diffuser fixing protrusion is inserted into the penetration hole to prevent the diffuser from being separated from the upper support.

An intake sound is tuned by changing a size and shape of the through-holes formed inside the upper reinforcing ribs.

The upper support of which the shapes of the upper reinforcing ribs are changed according to the required specification of the air cleaner may be fitted to the air cleaner body.

A diffuser fixing hook of a hook shape may be formed at the end portion of the diffuser; and the diffuser fixing hook may be fastened to the air cleaner cover.

In accordance with an air cleaner assembly of a vehicle having a supporting member according to the present disclosure, the stiffness of the air cleaner is improved by installing the upper and lower supports inside the air cleaner, without any major deformation of the mold to make the air cleaner.

Further, the flow of air circulating inside the air cleaner is changed so that the intake sound can be tuned without a separate sound generator.

Further, the air cleaner body and the air cleaner cover are constructed in a common structure, and the shape of the lower support and the upper support, which are fitted to the interior of the air cleaner body and the air cleaner cover, respectively, are made different from each other, thereby realizing air cleaners of various specifications.

BRIEF DESCRIPTION OF THE DRAWINGS

The above and other objects, features and advantages of the present disclosure will be more clearly understood from the following detailed description taken in conjunction with the accompanying drawings, in which.

DESCRIPTION OF PREFERRED EMBODIMENTS

Figure 1:
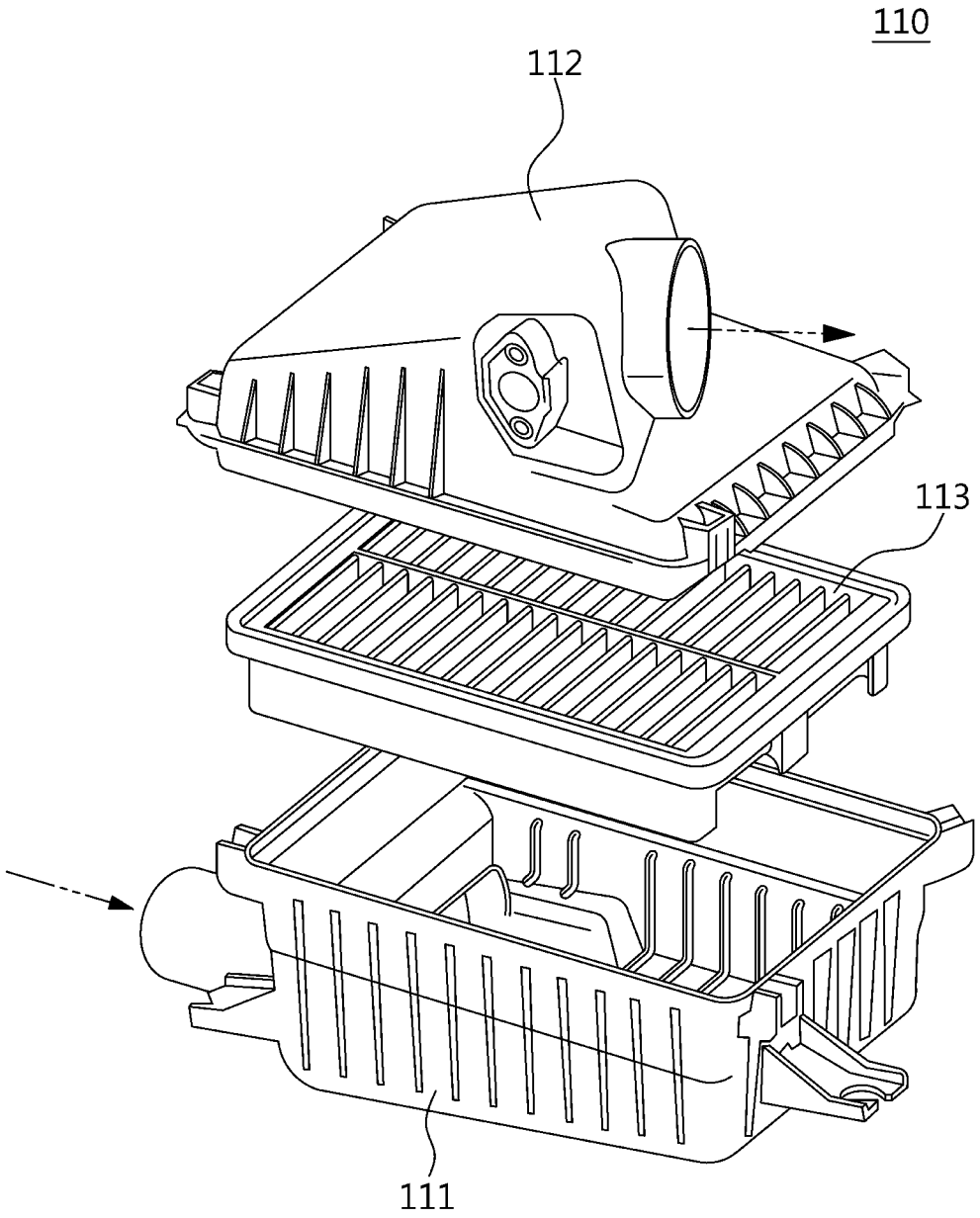
FIG. 1 RELATED ART
FIG. 1 (RELATED ART) is an exploded perspective view showing the air cleaner according to the conventional art.
Figure 2:
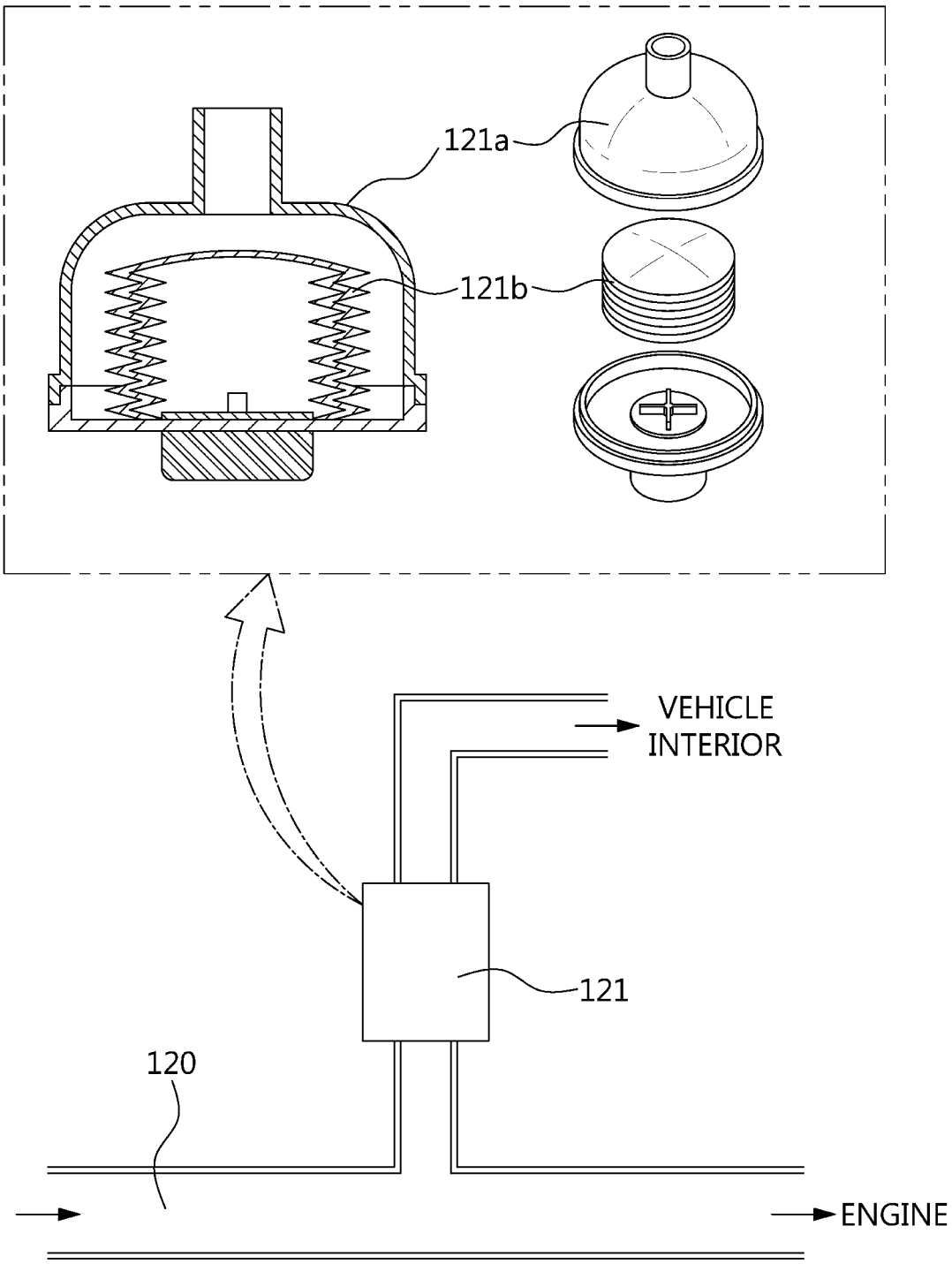
FIG. 2 RELATED ART
FIG. 2 (RELATED ART) is a schematic view showing the mechanical sound generator installed on the intake pipe to tune the intake sound according to the conventional art.
Figure 3:
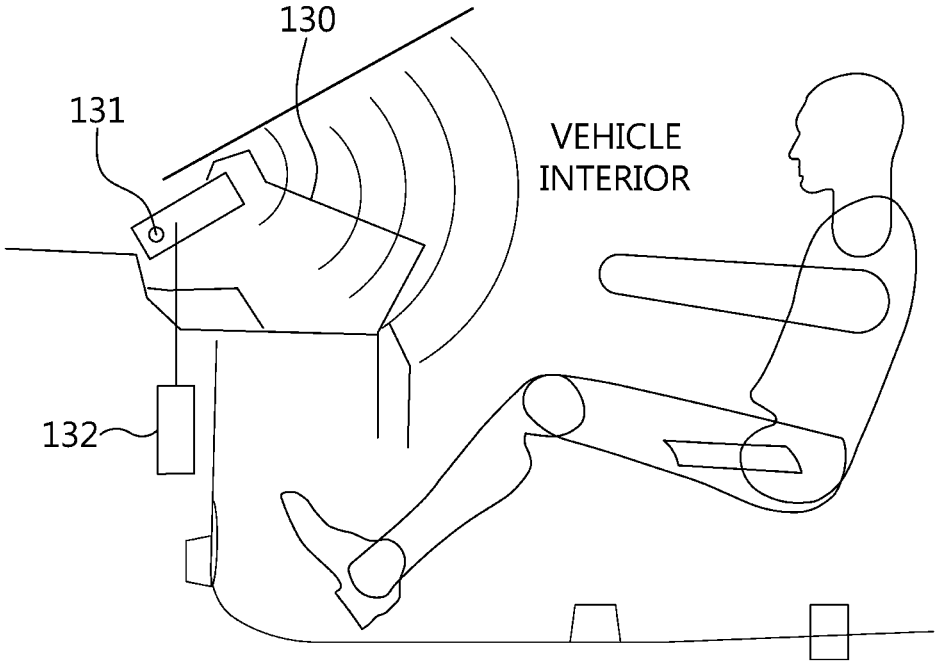
FIG. 3 RELATED ART
FIG. 3 (RELATED ART) is a schematic view showing the electronic sound generator installed on the cowl panel to tune the intake sound according to the conventional art.
Figure 4:
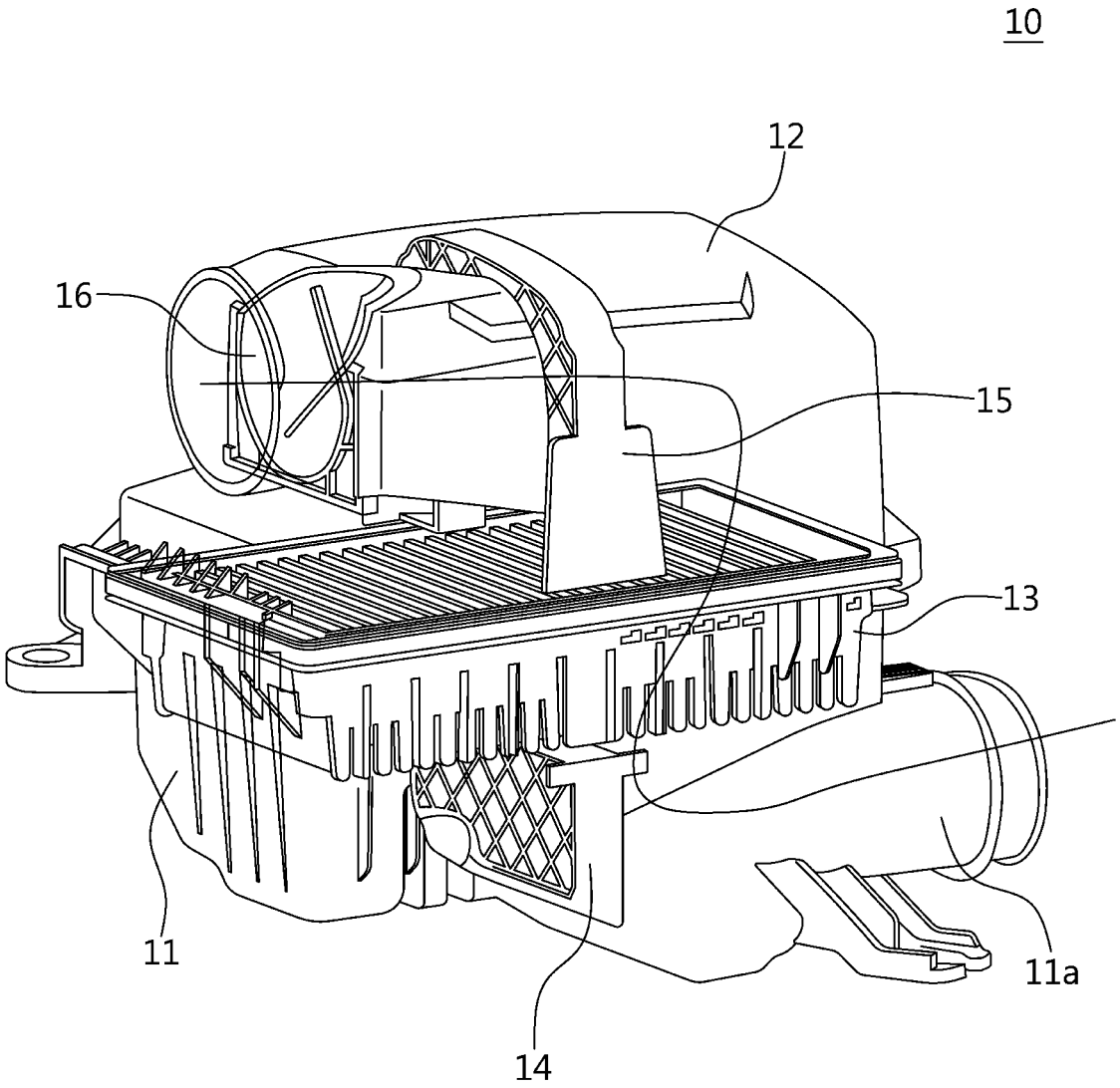
FIG. 4 is a perspective view showing an air cleaner assembly of a vehicle having a supporting member according to the present disclosure.
Figure 5:
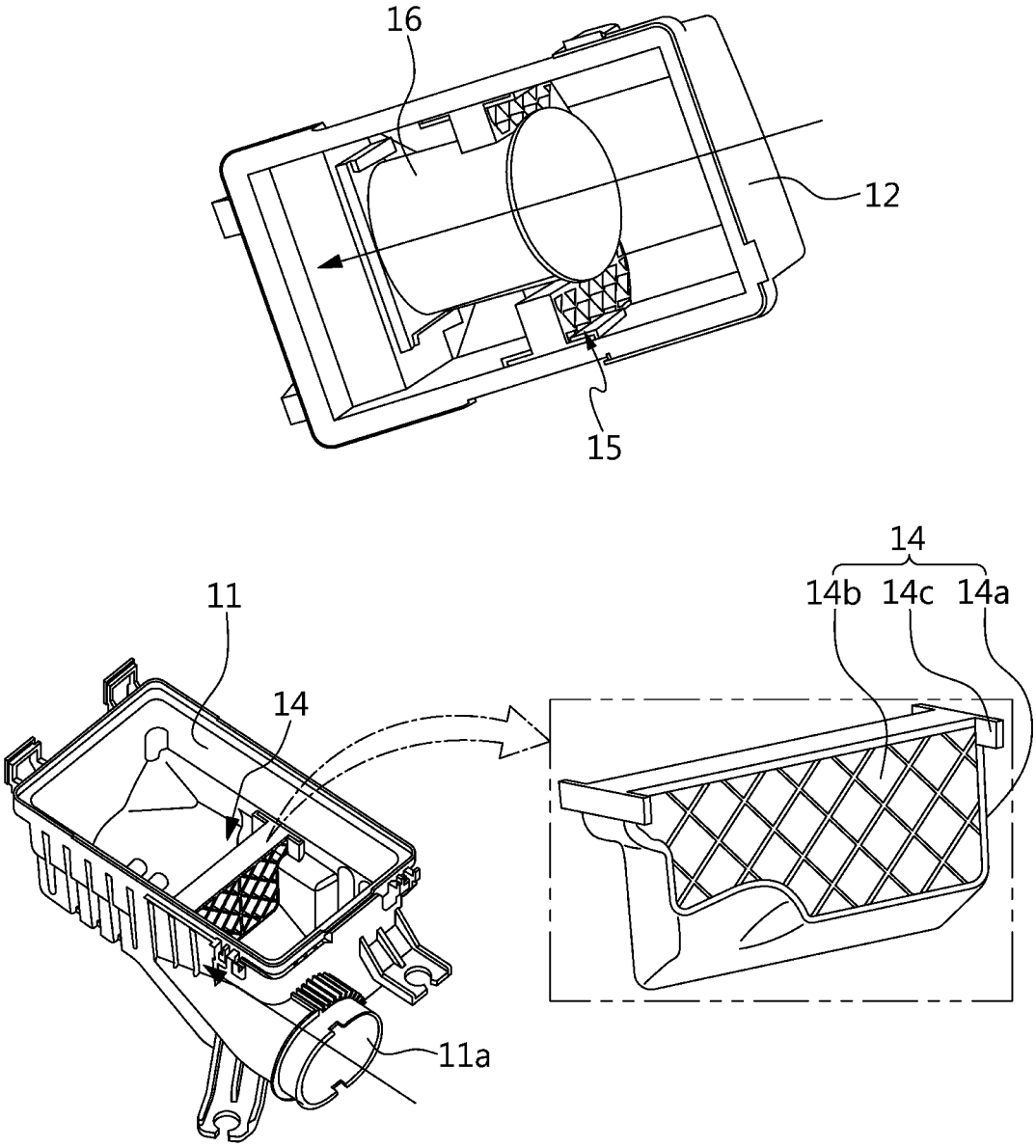
FIG. 5 is a schematic perspective view illustrating the air cleaner assembly of FIG. 4 according to the present disclosure.
Figure 6:
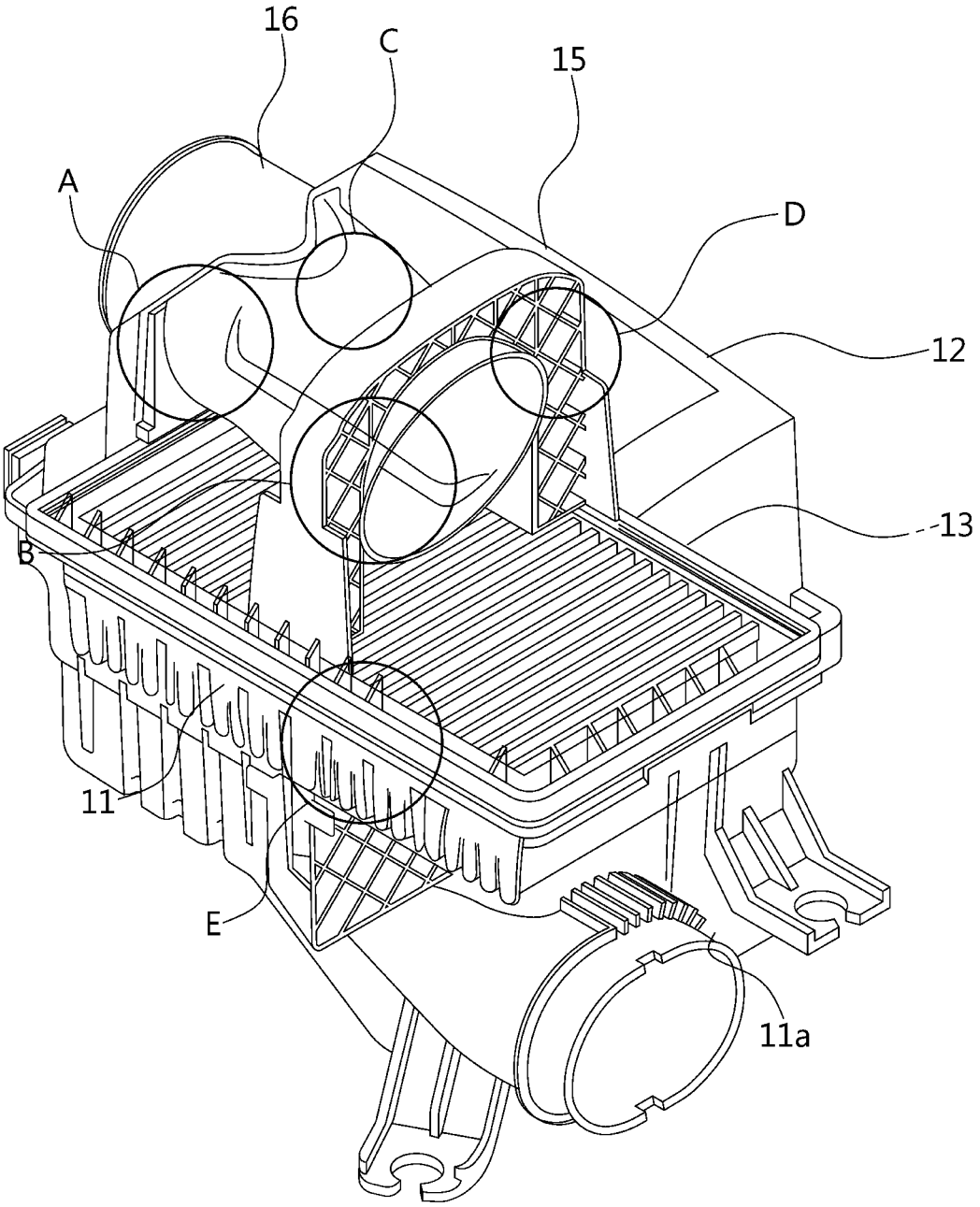
FIG. 6 is a perspective view illustrating the air cleaner assembly in another direction as compared to FIG. 4.
Figure 7:
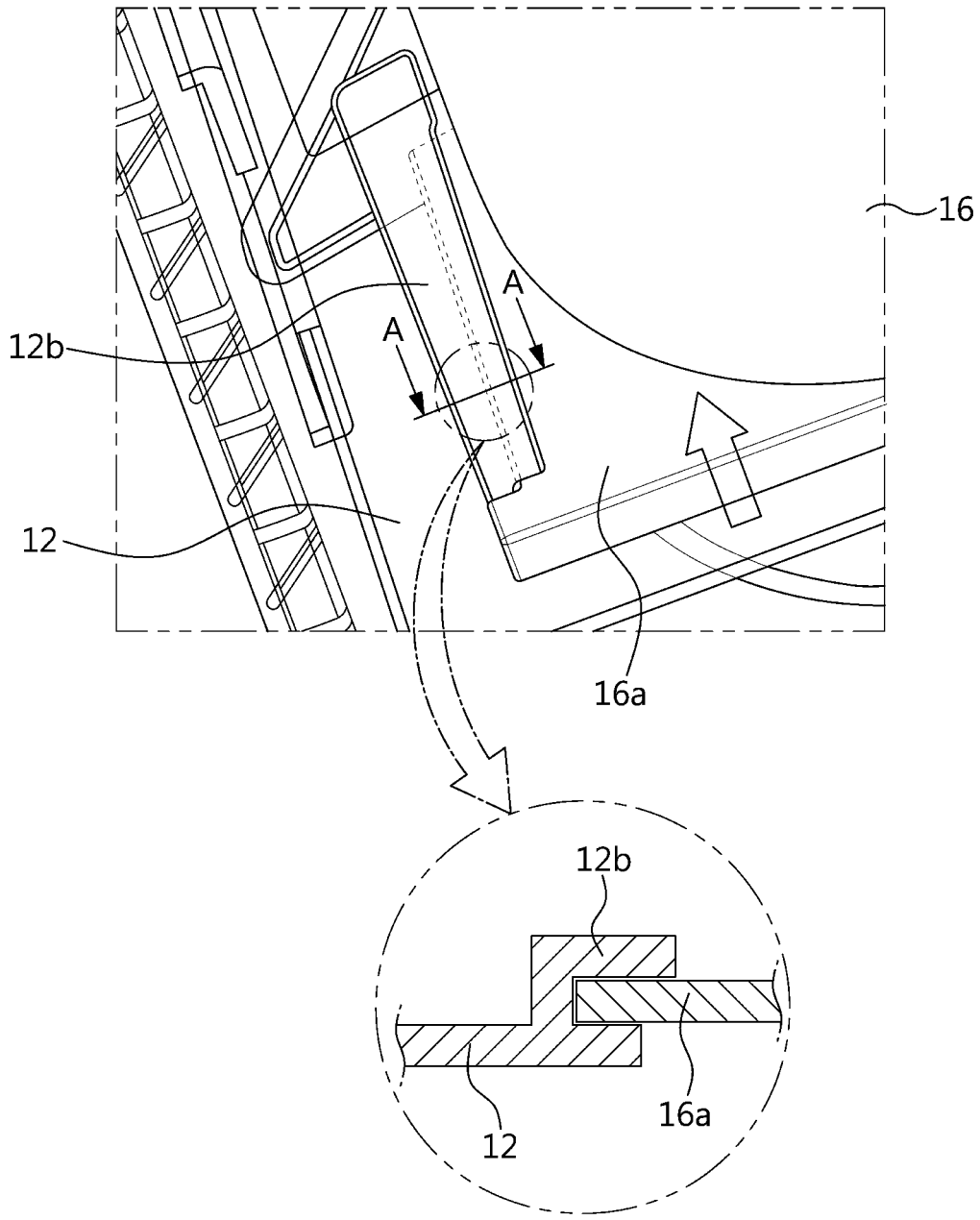
FIG. 7 is a detailed view of the part A depicted in FIG. 6.
Figure 8A:
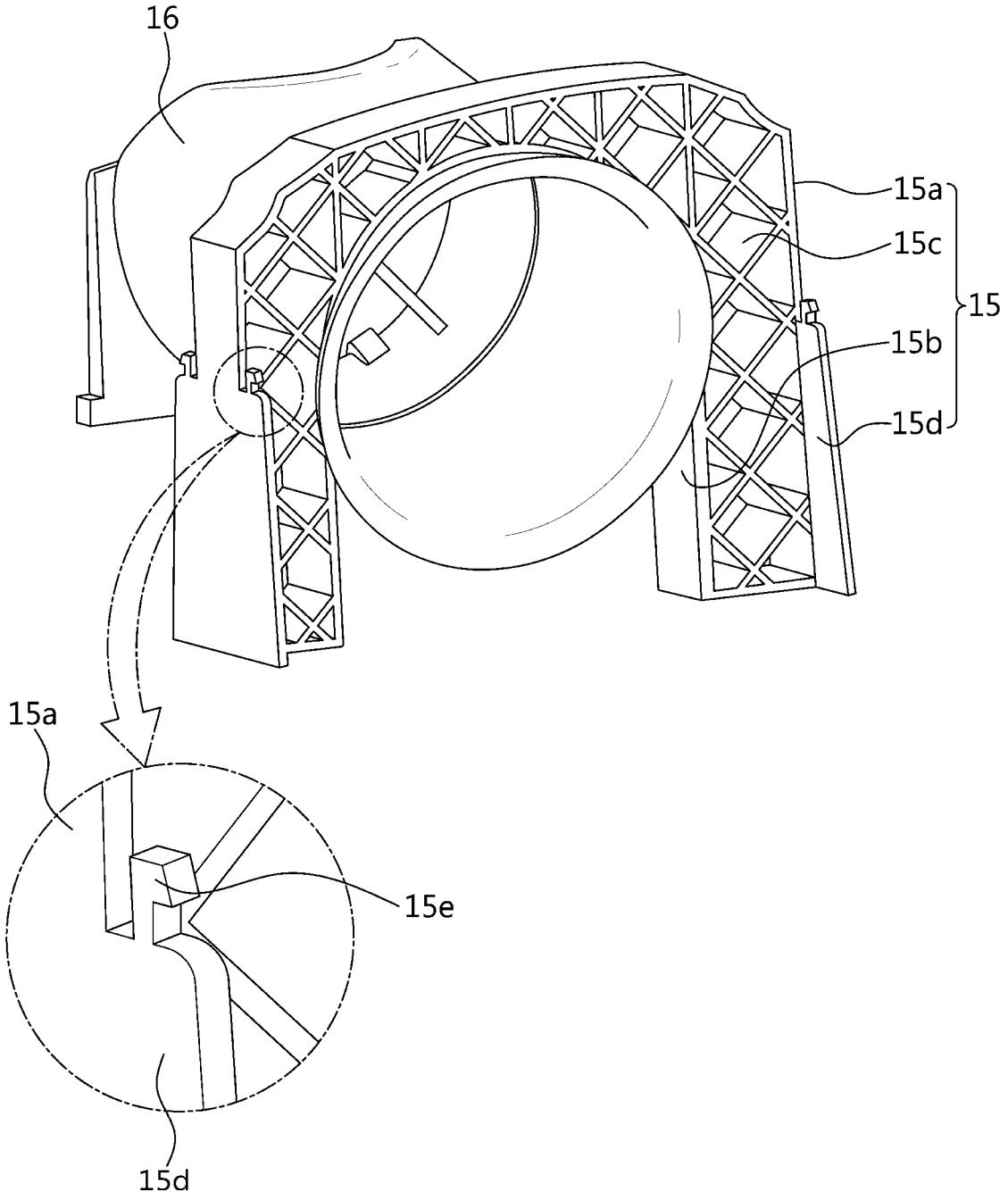
FIG. 8A and FIG. 8B are detailed views of the part B depicted in FIG. 6.
Figure 8B:
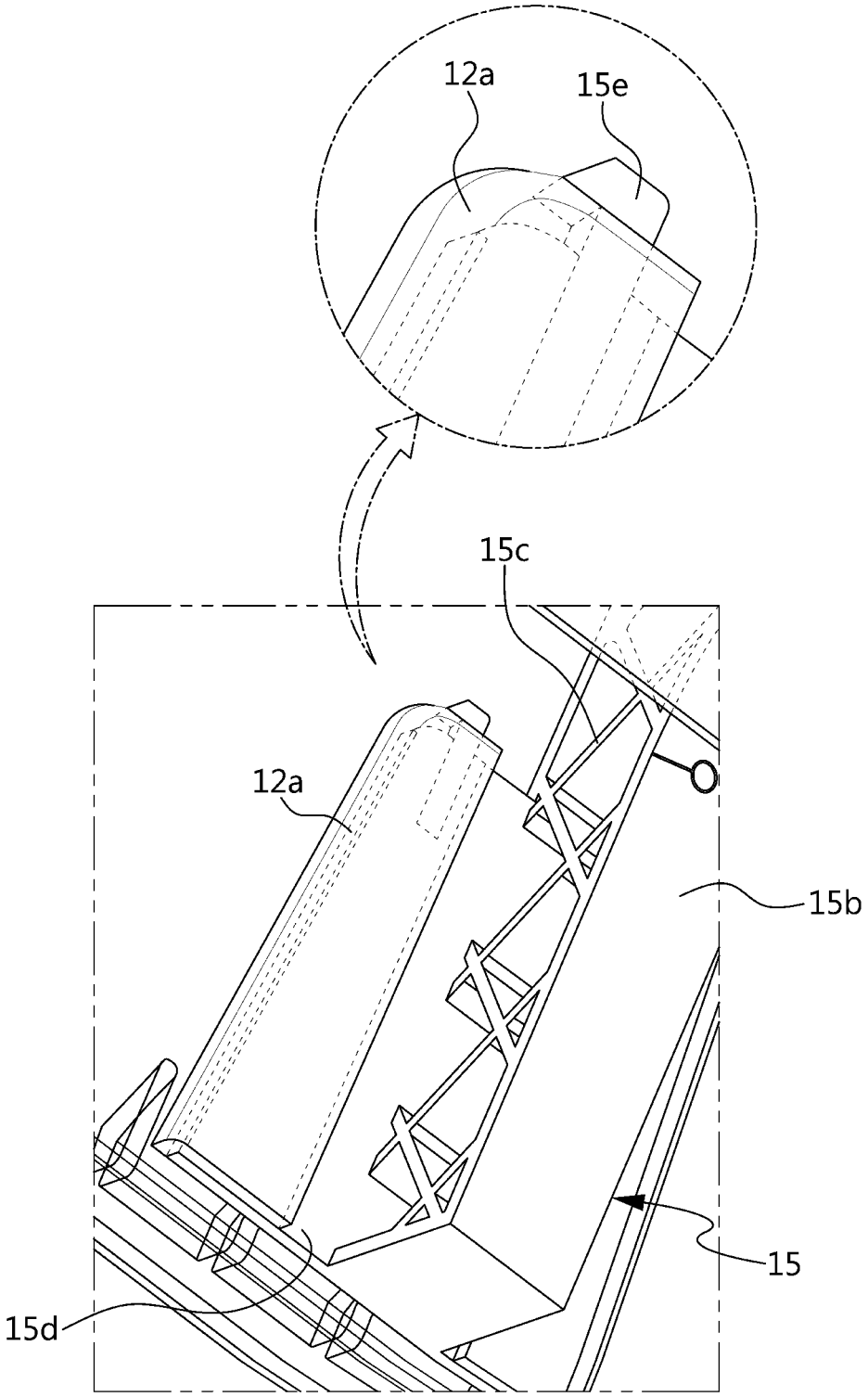
Figure 9:
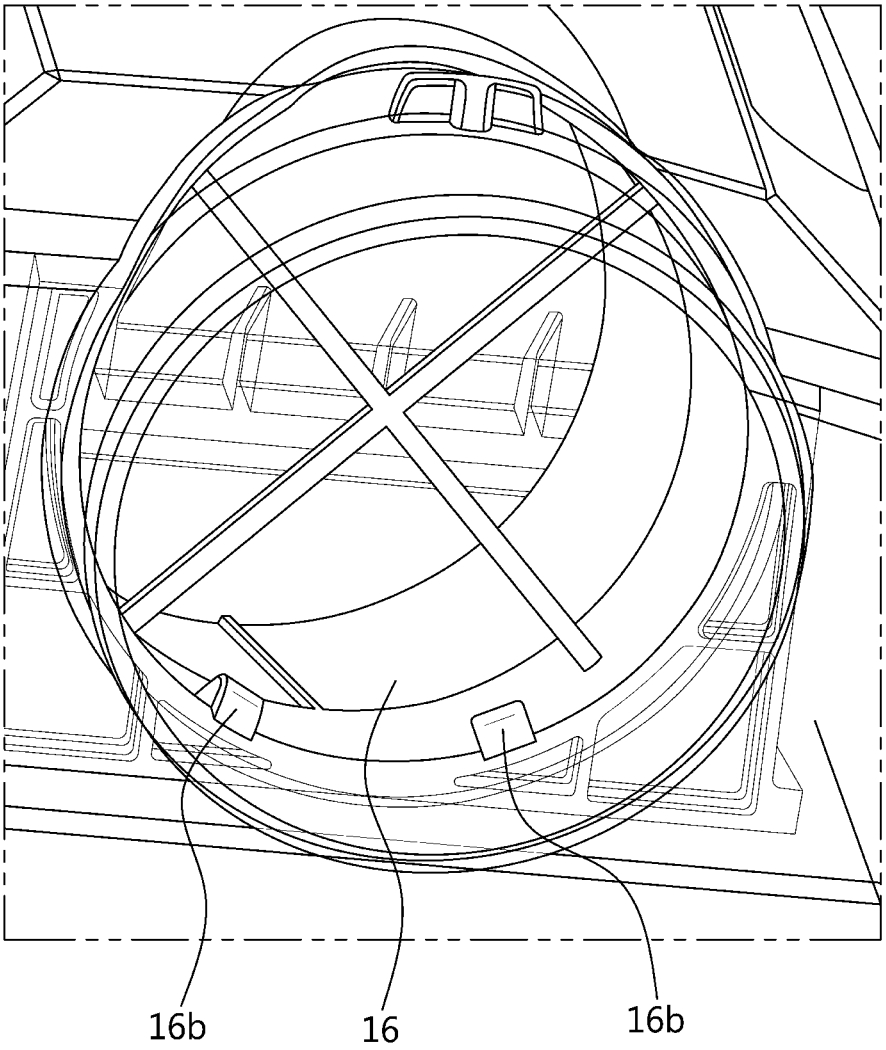
FIG. 9 is a detailed view of the part C depicted in FIG. 6.
Figure 10:
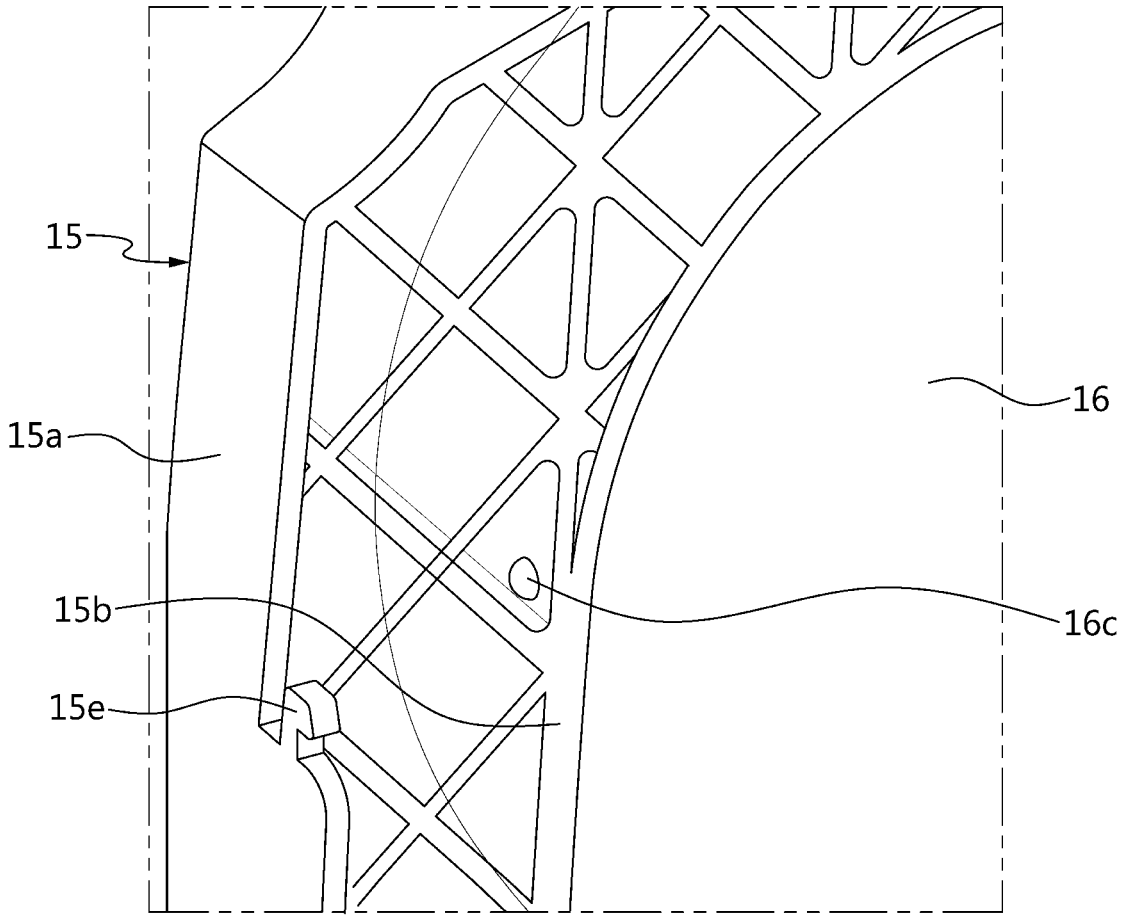
FIG. 10 is a detailed view of the part D depicted in FIG. 6.
Figure 11:
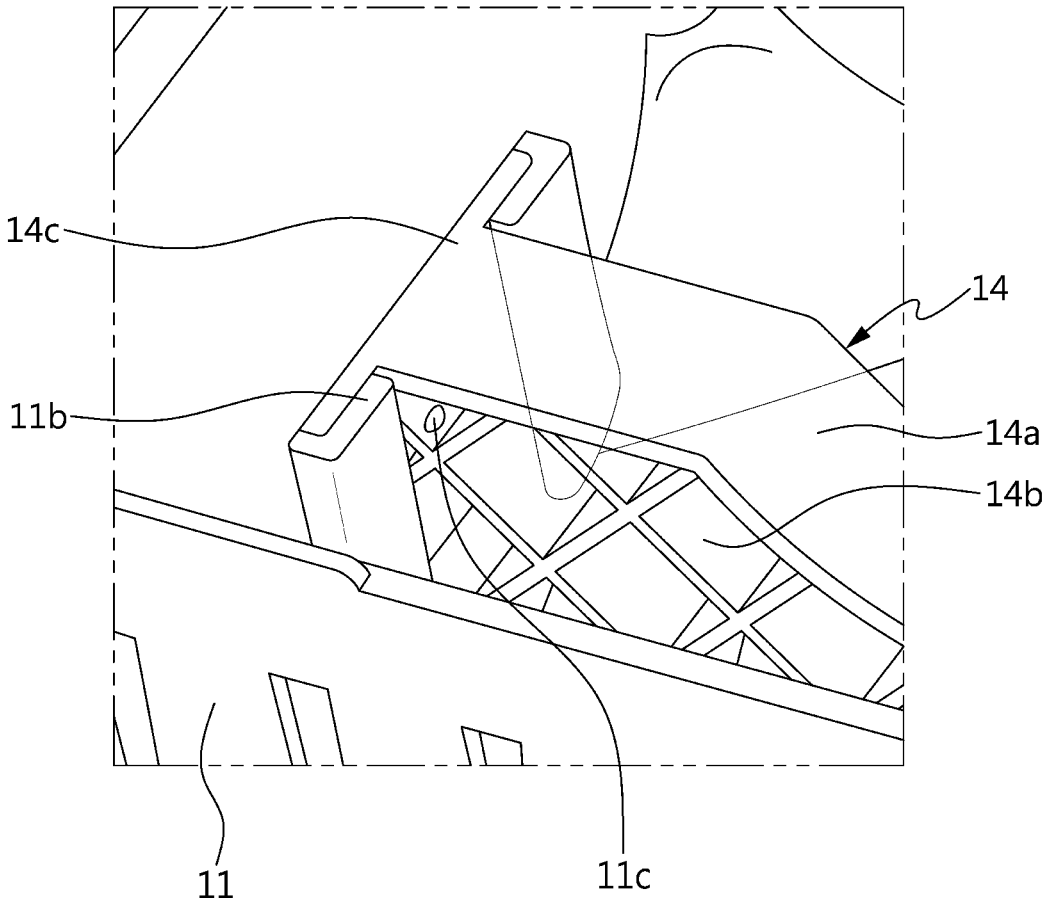
FIG. 11 is a detailed view of the part E depicted in FIG. 6.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, exemplary embodiments of the present disclosure will be described in detail with reference to the accompanying drawings. These embodiments are to be considered as illustrative and not restrictive, as those skilled in the art will readily appreciate that various modifications, additions and substitutions are possible, without departing from the scope and spirit of the disclosure as disclosed in the accompanying claims.

An air cleaner assembly of a vehicle having a supporting member according to the present disclosure may include an air cleaner body 11 into which air flows from the outside, an air cleaner cover 12 which is fastened to the air cleaner body 11 and in which the filtered air 11 is exhausted, and an air filter 13*a* installed between the air cleaner body 11 and the air cleaner cover 12 to filter foreign material. In the air cleaner of the vehicle installed on the intake pipe introducing air from the outside to the engine, the air cleaner cover 12 may be provided with a diffuser 16 for guiding the exhaust of the filtered air, and a supporting member is installed at the air cleaner body 11 and the air cleaner cover 12, respectively, by which the air can pass through the diffuser 16 in a longitudinal direction while supporting the outer surface of the diffuser 16 on the air cleaner body 11 and the air cleaner cover 12.

One side of the air cleaner body 11 may include a suction port 11*a* through which air flows into from the outside, and a space is formed inside the air cleaner body 11 to receive the air flowed onto from the outside.

The air cleaner cover 12 may be fitted on the upper surface of the air cleaner body 11 to be assembled. At one side of the air cleaner cover 12 may be formed an outlet for exhausting air and a space may be formed therein to accommodate the filtered air.

The air filter 13 may be installed between the air cleaner body 11 and the air cleaner cover 12. The air filter 13 may be made of a non-woven fabric so that the foreign material is removed while the air passes through the air filter 13. The air filter 13 may be fixed in the interior of the air cleaner 10 with the top portion thereof fixed when the air cleaner cover 12 is fastened to the air cleaner body 11 while the circumference thereof is seated in the air cleaner body 11.

The air flowed into the suction port 11*a* passes through the air filter 13 so that foreign material is filtered, and then, supplied to an engine through the air cleaner cover 12.

The diffuser 16 may be fixedly mounted on the air cleaner cover 12, which functions to direct the filtered air toward the engine and an intake hose.

The supporting member serves to fix the diffuser 16 to a predetermined position within the air cleaner 10 and also tunes the intake sound of air passing through the supporting member. The supporting member may be formed to extend in the radial direction of the diffuser 16 to support the outer surface of the diffuser 16 on the inner surface of the air cleaner body 11 or the inner surface of the air cleaner cover 12 directly or indirectly. By this, the position of the diffuser 16 may be fixed inside the air cleaner 10.

The supporting member may include a lower support 14 supporting the diffuser 16 from below to be supported on the air cleaner body 11 and an upper support 15 contacts the circumference portion of the diffuser 16 to be supported on the inner surface of the air cleaner cover 12. The lower support 14 and the upper support 15 is not integrally formed with the air cleaner body 11 and the air cleaner cover 12, respectively, but may be formed with various shapes to be fitted to the air cleaner 10 in the attachable and detachable manner according to the specifications of the air cleaner 10.

The lower support 14 may include a rim portion 14*a* surrounding the circumference of the air cleaner body 11 and the bottom surface of the air filter 13 and a lower reinforcing ribs 14*b* dividing an inside of the rim portion 14*a* therein and having through-holes formed with a constant cross-sectional area along the longitudinal direction of the diffuser 16. The lower support 14 directly supports an outer lower end portion of the diffuser 16 or indirectly through the air filter 13. For example, when the air filter 13 is installed between the lower support 14 and the diffuser 16, the lower support 14 indirectly supports the diffuser 16.

The rim portion 14*a* may be formed along the circumference of the lower support 14. The rim portion 14*a* may be formed to have a predetermined width along the longitudinal direction of the diffuser 16.

The lower reinforcing ribs 14*b* may divide the inside of the rim portion 14*a*, and form through-holes of a constant cross-section along the longitudinal direction of the diffuser 16. For example, the lower reinforcing ribs 14*b* can divide an inner space of the rim portion 14*a* into a truss shape, a lattice shape, a honeycomb shape cross-section, and the like. For the whole of the rim portion 14*a*, the inside of the rim portion 14*a* may be divided into polygon or several cross-sectional shapes by the lower reinforcing ribs 14*b*.

The lower reinforcing ribs 14*b* serve to increase the strength of the lower support 14.

In addition, the lower reinforcing ribs 14*b* serve to tune the intake sound generated by air passing through the lower support 14. It is possible to tune the intake sound generated by air passing through the lower support 14 by adjusting the length of the lower reinforcing ribs 14*b* (the length of the axial direction of the diffuser), the area and the cross-sectional shape of the through-holes defined by the lower reinforcing ribs 14*b*.

A configuration may be further provided in order to easily fasten the lower support 14 and the air cleaner body 11 and prevent the lower support 14 from being separated the air cleaner body 11.

A part of the rim portion 14*a* may be inserted into and assembled to the air cleaner body 11. A part of the rim portion 14*a* may be formed to a lower support fixing flange 14*c* which is formed to extend in the longitudinal direction of the diffuser 16, and the inner surface of the air cleaner body 11 may be provided with a lower support holder 11*b* into which the lower support fixing flange 14*c* is inserted. The lower support fixing flange 14*c* is inserted into the lower support holder 11*b*, so that the rim portion 14*a* is fixed at the air cleaner body 11. The lower support 14 can be fixed inside the air cleaner body 11 by inserting the rim portion 14*a* in a sliding manner.

Further, a lower support fixing protrusion 11*c* may be formed at the inner surface of the air cleaner body 11 to protrude from the inner surface of the air cleaner body 11, so that it is able to prevent the lower support 14 from being separated from the air cleaner body 11. A fixing groove accommodating the lower support fixing protrusion 11*c* may be formed at the rim portion 14*a* of the lower support 14. When the lower support 14 is seated on a predetermined position inside the air cleaner body 11, the lower support fixing protrusion 11*c* is fixedly fitted to the fixing groove, so that it is able to prevent the lower support 14 from being separated from the air cleaner body 11.

The lower support 14 may be manufactured so that the shape, area, spacing, etc. of the through-holes formed by the lower reinforcing ribs 14*b* are varied depending on the specifications of the air cleaner 10, for example, the required strength and the radiant noise, and fitted to the air cleaner body 11.

The upper support 15 may support the inside circumference of the diffuser 16 and contact with an inside surface of the air cleaner cover 12. Unlike the lower support 14, the upper support 15 may directly support most of the outside circumference of the diffuser 16 except for the portion where the diffuser 16 contacts the air filter 13.

The upper support 15 may include an outer rim 15*a* that contacts the inside surface of the air cleaner cover 12, an inner rim 15*b* of which the middle portion covers the outside circumference of the diffuser 16, the portion not adjacent to the diffuser 16 contacts the upper surface of the air filter 13, and both end portions are connected with the outer rim 15*a*, respectively, where upper reinforcing ribs 15*c* divide the inner space formed by the outer rim 15*a* and the inner rim 15*b*, and form through-holes of a constant cross-sectional area along the longitudinal direction of the diffuser 16.

The outer rim 15*a* may be formed to contact with the inside surface of the air cleaner cover 12.

The middle portion of the inner rim 15*b* covers the outside circumference of the diffuser 16, and the portion adjacent to both end portions, that is, the portion not adjacent to the diffuser 16, contacts the upper surface of the air filter 13.

The end portion of the inner rim 15*b* may be connected with the end portion of the outer rim 15*a*. A space in the form of approximately an inverted U-shape is formed by connecting the outer rim 15*a* and the inner rim 15*b*.

The upper reinforcing ribs 15*c* may divide the inner space formed by the outer rim 15*a* and the inner rim 15*b* in a manner similar to the lower reinforcing ribs 14*b* and may form through-holes of a constant cross-sectional area along the longitudinal direction of the diffuser 16. The upper reinforcing ribs 15*c* may divide the inner space of the outer rim 15*a* and the inner rim 15*b* in the form of truss, lattice, honeycomb shape, etc. For the entire outer rim 15*a* and the inner rim 15*b*, the inner reinforcing ribs 15*c* may divide the inside of the space formed between the outer rim 15*a* and the inner rim 15*b* by a polygon or various types of cross-sectional shapes.

The upper reinforcing ribs 15*c*, like the lower reinforcing ribs 14*b*, serve to enhance the strength of the upper support 15.

In addition, like the lower reinforcing ribs 14*b*, the upper reinforcing ribs 15*c* serve to tune the intake sound generated by the air passing through the upper support 15. It is possible to tune the intake sound of air passing through 14 by adjusting the length of the lower reinforcing ribs 14*b* (the length of the axial direction of the diffuser), the area of the through-holes defined by the lower reinforcing ribs 14*b*, or the cross-sectional shape of the through-holes defined by the lower reinforcing ribs 14*b* the lower reinforcing ribs 14*b*.

A configuration, which facilitates fastening when fastening the upper support 15 to the air cleaner cover 12 and prevents the separation thereof after fastening, may be applied.

One side of the outer rim 15*a* extends in the longitudinal direction of the diffuser 16 to form an upper support fixing flange 15*d*, and an upper support holder 12*a* may be formed to which the upper support fixing flange 15*d* is fitted at the inside surface of the air cleaner cover 12. When fitting the upper support fixing flange 15*d* to the upper support holder 12*a* in a sliding manner, it is able to easily fasten the upper support 15 to the air cleaner cover 12.

Herein, an upper support fixing hook 15*e* hanged at the upper end portion of the upper support holder 12*a* may be formed at the upper end portion of the upper support fixing flange 15*d*. When the upper support fixing flange 15*d* is completely fitted to the upper support holder 12*a*, the upper support fixing flange 15*d* is not separated by the upper support fixing hook 15*e*, so that it is prevented the upper support 15 from being separated from the air cleaner cover 12.

A configuration for preventing separation between the diffuser 16 and the upper support 15 may be provided at the upper support 15. A penetration hole may be formed at the inner rim 15*b*, and a diffuser fixing protrusion 16*c* inserted into the penetration hole may be formed at an outside surface of the diffuser 16, so that the diffuser fixing protrusion 16*c* is inserted into the penetration hole to prevent the diffuser 16 from being separated from the upper support 15.

The upper support 15 may be manufactured so that the shape, area and spacing, etc. of the through-holes formed by the upper reinforcing ribs 15*c* are varied depending on the specifications of the air cleaner 10, for example, the required strength and the radiant noise, and fitted to the air cleaner cover 12.

On the other hand, when the diffuser 16 is coupled to the air cleaner cover 12, a diffuser fixing flange 16*a* formed at the diffuser 16 is inserted into a diffuser holder 12*a* formed at the air cleaner cover 12 to be coupled thereto. The diffuser fixing flange 16*a* may be formed at the end portion of the diffuser 16 to extend in the radial direction of the diffuser 16. The diffuser holder 12*a* may be formed at the air cleaner cover 12 to grasp the diffuser fixing flange 16*a*, and the diffuser fixing flange 16*a* is inserted into the diffuser holder 12*a* to be coupled thereto. This is equivalent to mounting the lower support 14 on the air cleaner body 11, and mounting the upper support 15 on the air cleaner cover 12.

Further, in order to prevent the diffuser 16 from being separated from the air cleaner cover 12, a diffuser fixing hook 16*b* is formed at the end portion of the diffuser 16, and the diffuser fixing hook 16*b* is inserted into a fixing groove formed at the air cleaner cover. When the diffuser 16 is completely assembled the air cleaner cover 12, the diffuser fixing hook 16*b* is inserted into the fixing groove to be fastened thereto, so that it is able to prevent the diffuser 16 from being separated from the air cleaner cover 12.

In the present disclosure, the lower support 14 and the upper support 15 are assembled to the air cleaner body 11 and the air cleaner cover 12, respectively, in a fitting manner. Therefore, since only the shapes of the lower support 14 and the upper support 15 are changed according to the air cleaner 10, it is possible to simplify molds. That is, the shapes of the air cleaner body 11 and the air cleaner cover 12 are simplified to be manufactured, and the lower support 14 and the upper support 15 fitted thereto are changed corresponding to the air cleaner body 11 and the air cleaner cover 12. Since it is able to simplify the shapes of the air cleaner body 11 and the air cleaner cover 12, it is possible to apply various vehicle models. Further, various types of radiation sound can be realized by changing the shapes of the lower support 14 and the upper support 15 according to the specifications of the air cleaner and applying them.

What is claimed is:

1. An air cleaner assembly of a vehicle, comprising:

an air cleaner body into which air flows from outside;

an air cleaner cover which is fastened to the air cleaner body and from which filtered air is exhausted;

an air filter installed between the air cleaner body and the air cleaner cover to filter foreign material, and which is installed at an intake pipe introducing air into an engine from outside;

a diffuser guiding the exhaust of the filtered air, the diffuser being installed at the air cleaner cover; and a plurality of supporting members including a lower support and an upper support that respectively support an outside surface of the diffuser on the air cleaner body and the air cleaner cover, and allow air to pass in a longitudinal direction of the diffuser, the lower support and the upper support being installed at the air cleaner body and the air cleaner cover, respectively, wherein the lower support extends in a radial direction of the diffuser, supports an outer lower end portion of the diffuser, and contacts an inside surface of the air cleaner body, wherein the upper support extends in the radial direction of the diffuser, supports an outside circumference of the diffuser, and contacts an inside surface of the air cleaner cover, wherein the lower support and the upper support are fixedly fitted to the air cleaner body and the air cleaner cover, respectively, and wherein all of the air exhausted from the air cleaner cover flows through the diffuser.

2. The air cleaner assembly of claim 1, wherein an air filter is installed between the lower support and the diffuser.

3. The air cleaner assembly of claim 2, wherein the lower support comprises:

a rim portion supporting the inside surface of the air cleaner body and a lower surface of the air filter; and lower reinforcing ribs dividing an inner space in an inside of the rim portion and forming through-holes of a constant cross-sectional area in the longitudinal direction of the diffuser.

4. The air cleaner assembly of claim 3, wherein:

a part of the rim portion contacting the air cleaner body forms a lower support fixing flange which extends in the longitudinal direction of the diffuser; and a lower support holder is formed to protrude from the inside surface of the air cleaner body and accommodates the lower support fixing flange, so that the lower support fixing flange is fixedly fitted to the lower support holder.

5. The air cleaner assembly of claim 4, wherein:

a lower support fixing protrusion is formed at the inside surface of the air cleaner body to protrude from the inside surface of the air cleaner body; and a fixing groove accommodating the lower support fixing protrusion is formed at the rim portion of the lower support, so that the lower support fixing protrusion is fixedly fitted to the fixing groove when the lower support is seated at a predetermined position inside the air cleaner body.

6. The air cleaner assembly of claim 3, wherein an intake sound is tuned by changing a size and shape of the through-holes formed inside the lower reinforcing ribs.

7. The air cleaner assembly of claim 6, wherein the lower support of which the shapes of the lower reinforcing ribs are changed according to a required specification of the air cleaner is fitted to the air cleaner body.

8. The air cleaner assembly of claim 1, wherein the upper support comprises:

an outer rim contacting with the inside surface of the air cleaner cover;

an inner rim of which the middle portion covers the outside circumference of the diffuser, the portion not adjacent to the diffuser is in contact with the upper surface of the air filter and both end portions are connected with the outer rim, respectively; and upper reinforcing ribs dividing the inner space formed by the outer rim and the inner rim and forming through-holes of a constant cross-sectional area along the longitudinal direction of the diffuser.

9. The air cleaner assembly of claim 8, wherein:

one side of the outer rim forms an upper support fixing flange to extend in longitudinal direction of the diffuser; and an upper support holder accommodating the upper support fixing flange is formed at the inside surface of the air cleaner cover, so that the upper support fixing flange is fitted to the upper support holder in order that the upper support is mounted on the air cleaner cover.

10. The air cleaner assembly of claim 9, wherein an upper support fixing hook hanged on the upper end portion of the upper support holder is formed at the upper end portion of the upper support fixing flange in order to prevent the upper support fixing flange from being separated from the upper support holder.

11. The air cleaner assembly of claim 8, wherein:

a penetration hole is formed at the inner rim; and a diffuser fixing protrusion inserted into the penetration hole is formed at the outside surface of the diffuser, so that the diffuser fixing protrusion is inserted into the penetration hole to prevent the diffuser from being separated from the upper support.

12. The air cleaner assembly of claim 8, wherein an intake sound is tuned by changing a size and shape of the through-holes formed inside the upper reinforcing ribs.

13. The air cleaner assembly of claim 12, wherein the upper support of which the shapes of the upper reinforcing ribs are changed according to a required specification of the air cleaner is fitted to the air cleaner body.

14. The air cleaner assembly of claim 1, wherein:

a diffuser fixing hook of a hook shape is formed at the end portion of the diffuser; and the diffuser fixing hook is fastened to the air cleaner cover.

* * * * *